US007926540B2

(12) United States Patent
Lai

(10) Patent No.: US 7,926,540 B2
(45) Date of Patent: Apr. 19, 2011

(54) WINDOW BLIND WITH CONTROLLING AXLE

(76) Inventor: Tony Lai, Rowland Heights, CA (US)

( * ) Notice: Subject to any disclaimer, the term of this patent is extended or adjusted under 35 U.S.C. 154(b) by 169 days.

(21) Appl. No.: 12/284,715

(22) Filed: Sep. 23, 2008

(65) Prior Publication Data

US 2009/0314440 A1 Dec. 24, 2009

(51) Int. Cl.
*E06B 9/303* (2006.01)

(52) U.S. Cl. ..... 160/176.1 R; 160/115; 160/178.3

(58) Field of Classification Search ..... 160/115, 160/116, 176.1 R, 177 R, 178.1 R, 178.3
See application file for complete search history.

(56) References Cited

U.S. PATENT DOCUMENTS 2,148,812 A * 2/1939 Hollingsworth ..... 160/115
2,237,539 A * 4/1941 Adams et al. ..... 160/115
2,728,108 A * 12/1955 Schlegel, Jr. ..... 264/145
4,651,794 A * 3/1987 Bytheway, Jr. ..... 160/168.1 R
5,232,037 A * 8/1993 Fraser ..... 160/115
2002/0020506 A1* 2/2002 Dekker et al. ..... 160/115
2009/0314440 A1* 12/2009 Lai ..... 160/170
2010/0071858 A1* 3/2010 Lai ..... 160/170

* cited by examiner

*Primary Examiner* — Blair M. Johnson
(74) *Attorney, Agent, or Firm* — Raymond Y. Chan; David and Raymond Patent Firm

(57) ABSTRACT

The present invention relates to a controlling shaft, and more particularly to a controlling shaft for controlling blind, comprising a transverse shaft and a plurality of shaft controlling unit provided on the transverse shaft in turn. Due to the connecting relationship between the plurality of shaft controlling units and the transverse shaft, when the transverse shaft rotates, the plurality of shaft controlling units can synchronously rotate with the transverse shaft. Each shaft controlling unit of the plurality of shaft controlling units comprises a plurality of rotating members. When the shaft controlling unit rotates with the transverse shaft, the rotating members of each shaft controlling unit move in different pace. With the synchronous movement of the shaft controlling units with the transverse shaft, the particular points on the outer side of respective plurality of rotating members of any shaft controlling unit at the same level move to different extents.

9 Claims, 11 Drawing Sheets

WINDOW BLIND WITH CONTROLLING AXLE

BACKGROUND OF THE PRESENT INVENTION

1. Field of Invention

The present invention relates to a controlling shaft, and more particularly to a controlling shaft for controlling blind, comprising a transverse shaft and a plurality of shaft controlling unit provided on the transverse shaft in turn. Due to the connecting relationship between the plurality of shaft controlling units and the transverse shaft, when the transverse shaft rotates, the plurality of shaft controlling units can synchronously rotate with the transverse shaft. Each shaft controlling unit of the plurality of shaft controlling units comprises a plurality of rotating members. When the shaft controlling unit rotates with the transverse shaft, the rotating members of each shaft controlling unit move in different pace. With the synchronous movement of the shaft controlling units with the transverse shaft, the particular points on the outer side of respective plurality of rotating members of any shaft controlling unit at the same level move to different extents.

2. Description of Related Arts

As we all know, with the development of the society and the increasing demand for convenience of daily appliance, all kinds of appliances are developed, wherein the blind as one of the appliances is becoming more and more popular.

The curtain is very important in daily life. The traditional curtain is usually hung on the window in the house to block the lights in the day or to keep the in-house environment from being seen at outside at night.

The traditional curtain usually comprises a curtain frame and a curtain cloth provided on the curtain frame. When people want to block the light, hang the curtain cloth on the window via the curtain frame. However, folding and unfolding the traditional curtain is very inconvenient.

Then a kind of Persian blind is developed, which comprises a plurality of slats and a controlling shaft, wherein each slat is made of board shaped material, and the slats are connected in series via a controlling lift cord from top to bottom and are hung on the controlling shaft, so that the plurality of slats can switch between a horizontal status and a vertical status. In a horizontal status, the blind allows lights passing through, so that the user can observe the outside through the gap between the slats. When the user changes the slats from the horizontal status to vertical status via the controlling shaft, the slats can block the lights from the outside. The user can control the controlling shaft to switch the slats between the horizontal status and the vertical status, so as to control the blind.

In the above mentioned blind, it is the controlling shaft to connect the plurality of slats via the lift cord, which means when the user controls the controlling shaft, the slats rotate in the same pace. However, in some cases, the slats are required to rotate in different pace, so that the traditional blind can not meet this requirement, which is the main drawback of the traditional blind.

SUMMARY OF THE PRESENT INVENTION

The present invention is to provide a controlling shaft for controlling blind to overcome the above drawbacks.

A main object of the present invention is to provide a controlling shaft for controlling blind, which can control the slats of the blind rotating in different paces, so as to improve the performance of the blind.

Accordingly, in order to accomplish the above object, the present invention provides a controlling shaft for controlling blind. The blind comprises a cord lifting unit and a slat unit. The cord lifting unit comprises a plurality of lift cords, each of the lift cords has two controlling cords and a plurality of fixing cords, wherein two controlling cords are corresponding to each other, and a distance is between the two controlling cords. The fixing cords are provided between the two controlling cords from top to bottom, and a distance is between two neighbor fixing cords. Furthermore, each fixing cord comprises two or more transverse cords, and two neighbor transverse cords defines a fixing cavity. The slat unit is provided on the cord lifting unit, comprising a plurality of slat systems, and each slat systems is corresponding to a lift cord. Each slat system comprises a plurality of slats, and slats of a slat system are connected with the lift cord of the cord lifting unit from top to bottom.

The controlling shaft for controlling blind is provided on the beam of the blind, comprising a transverse shaft and a plurality of shaft controlling units, wherein the plurality of shaft controlling units is provided on the transverse shaft in turn. Due to the connecting relationship between the plurality of shaft controlling units and the transverse shaft, when the transverse shaft rotates, the plurality of shaft controlling units can synchronously rotate with the transverse shaft. Each shaft controlling unit of the plurality of shaft controlling units comprises a plurality of rotating members. When the shaft controlling unit rotates with the transverse shaft, the rotating members of the shaft controlling units move in different pace. With the synchronous movement of the shaft controlling units with the transverse shaft, the particular points on the outer side of respective plurality of rotating members of any shaft controlling unit at the same level move to different extents. In addition, the outer shape of the plurality of rotating members approximate to a column. The longitudinal axis of the plurality of rotating members that approximate to column is coincidence with the longitudinal axis of the transverse shaft, so that the rotating members rotate stably when rotating with the transverse shaft. The circumstances of the outer surface of each two rotating member of the plurality of rotating members are different with each other, so that when the plurality of shaft controlling units rotate synchronously with the transverse shaft to drive the plurality of rotating members to rotate, that is to say when the transverse shaft turns an angle, the plurality of rotating members turn the same angle, the particular points on the outer side of respective plurality of rotating members of any shaft controlling unit at the same level move to different extents. Each rotating member has a cord clap or a cord retaining hole provided thereon. The plurality of shaft controlling units are connected with the cord lifting unit of the blind, and furthermore, each rotating member of the plurality of shaft controlling units is connected with a lift cord of the cord lifting unit respectively. The slat unit is provided on the cord lifting unit, and each slat system of the slat unit is corresponding to a lift cord of the cord lifting unit. Each slat system comprises a plurality of slats, and the slats of the slat system are connected with a lift cord of the cord lifting unit from top to bottom. Due to the relationship between the rotating members, lift cords and the slats, the operation status of the slats can be controlled via the rotating members. The upper end of any group of lift cords of the cord lifting unit is fixed in the cord clap of the rotating member of the shaft controlling unit.

The benefit of the present invention is illustrated as follows. The controlling shaft for controlling blind comprises a transverse shaft and a plurality of shaft controlling units, wherein the plurality of shaft controlling units is provided on the transverse shaft in turn. Due to the connecting relationship between the plurality of shaft controlling units and the transverse shaft, when the transverse shaft rotates, the plurality of shaft controlling units can synchronously rotate with the transverse shaft. Each shaft controlling unit of the plurality of shaft controlling units comprises a plurality of rotating members. When the shaft controlling unit rotates with the transverse shaft, the rotating members of the shaft controlling units move in different pace. With the synchronous movement of the shaft controlling units with the transverse shaft, the particular points on the outer side of respective plurality of rotating members of any shaft controlling unit at the same level move to different extents. Therefore, the controlling shaft can control the slats of the blind rotating in different paces, so as to improve the performance of the blind.

These and other objectives, features, and advantages of the present invention will become apparent from the following detailed description, the accompanying drawings, and the appended claims.

DETAILED DESCRIPTION OF THE PREFERRED EMBODIMENT

Figure 1:
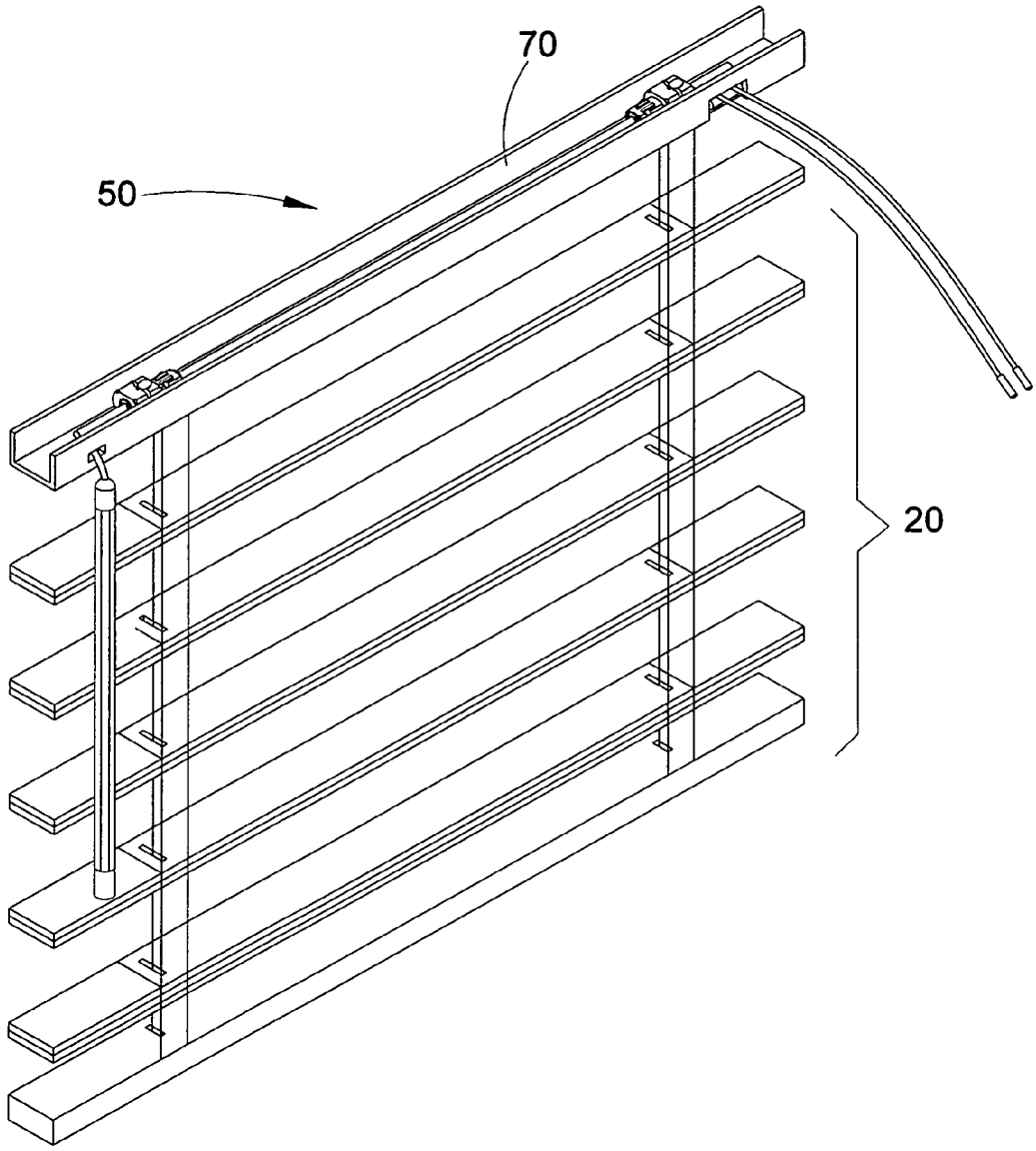
FIG. 1 is a perspective view of a blind according to a preferred embodiment of the present invention.
Figure 2:
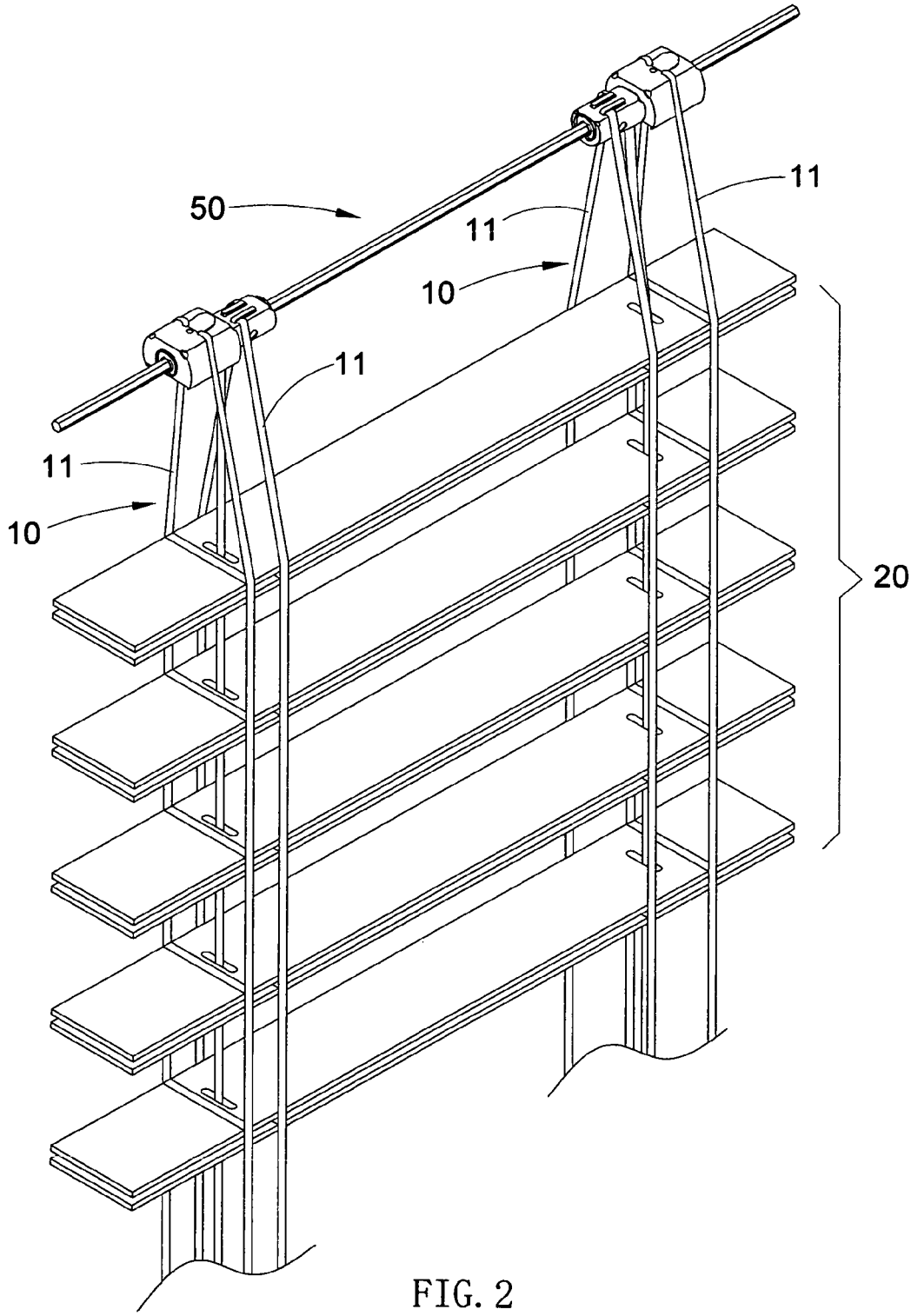
FIG. 2 is a perspective view of a cord lifting unit of the blind according to the above preferred embodiment of the present invention.
Figure 3:
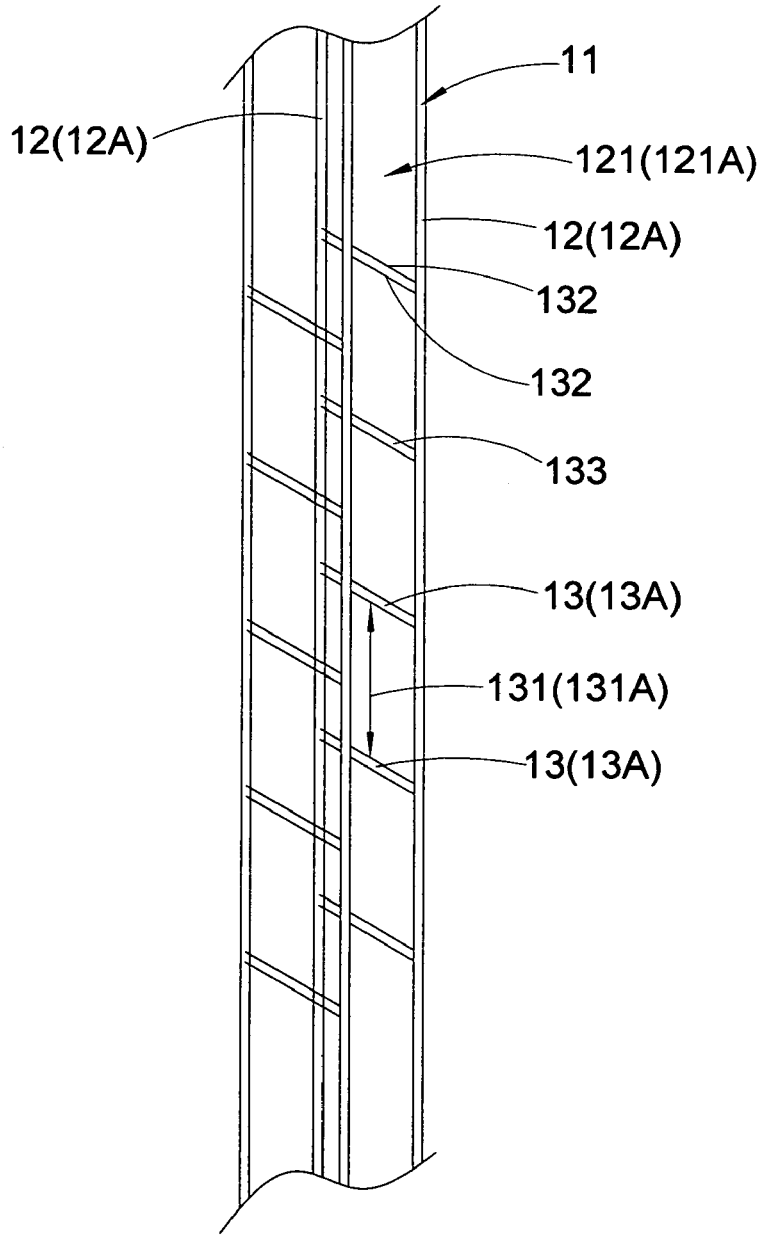
FIG. 3 is a perspective view of a slat unit of the blind according to the above preferred embodiment of the present invention.
Figure 4:
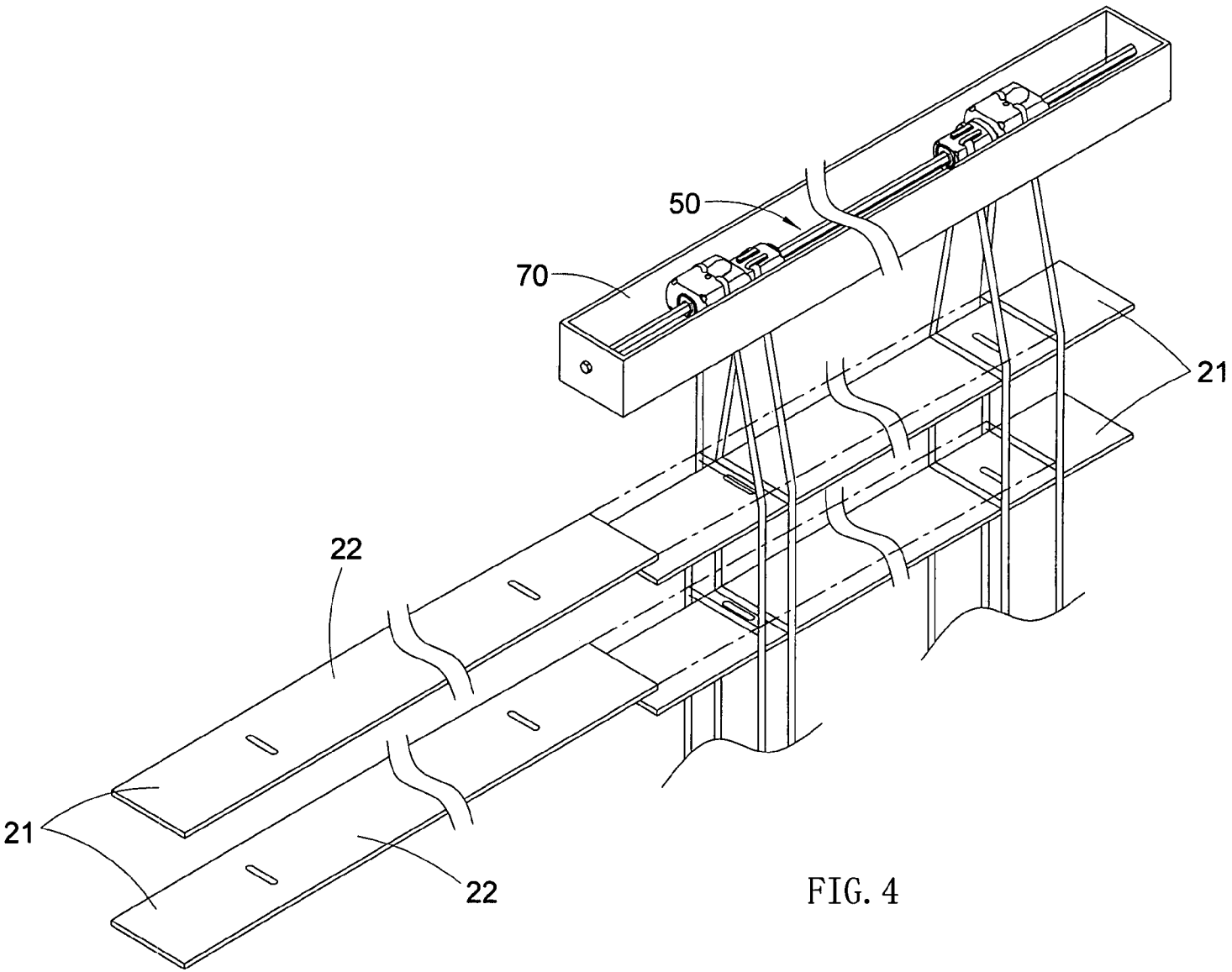
FIG. 4 is an exploded view of the blind according to the above preferred embodiment of the present invention.
Figure 5:
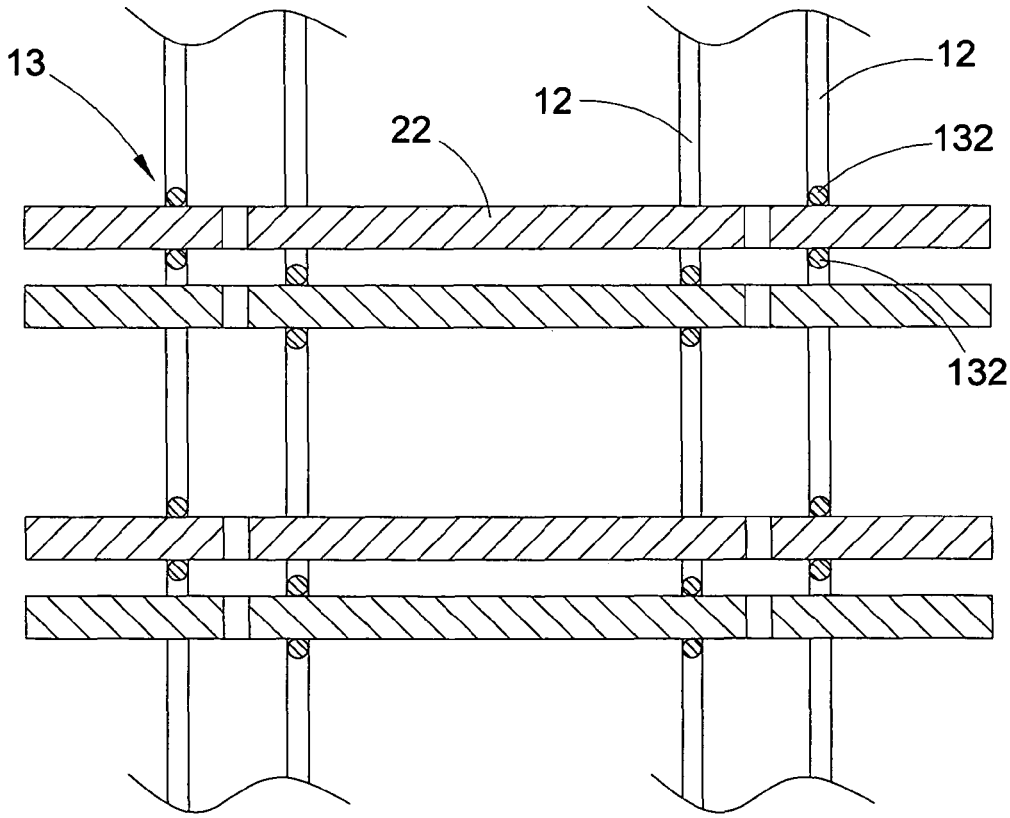
FIG. 5 is a sectional view of the blind according to the above preferred embodiment of the present invention.
Figure 6A:
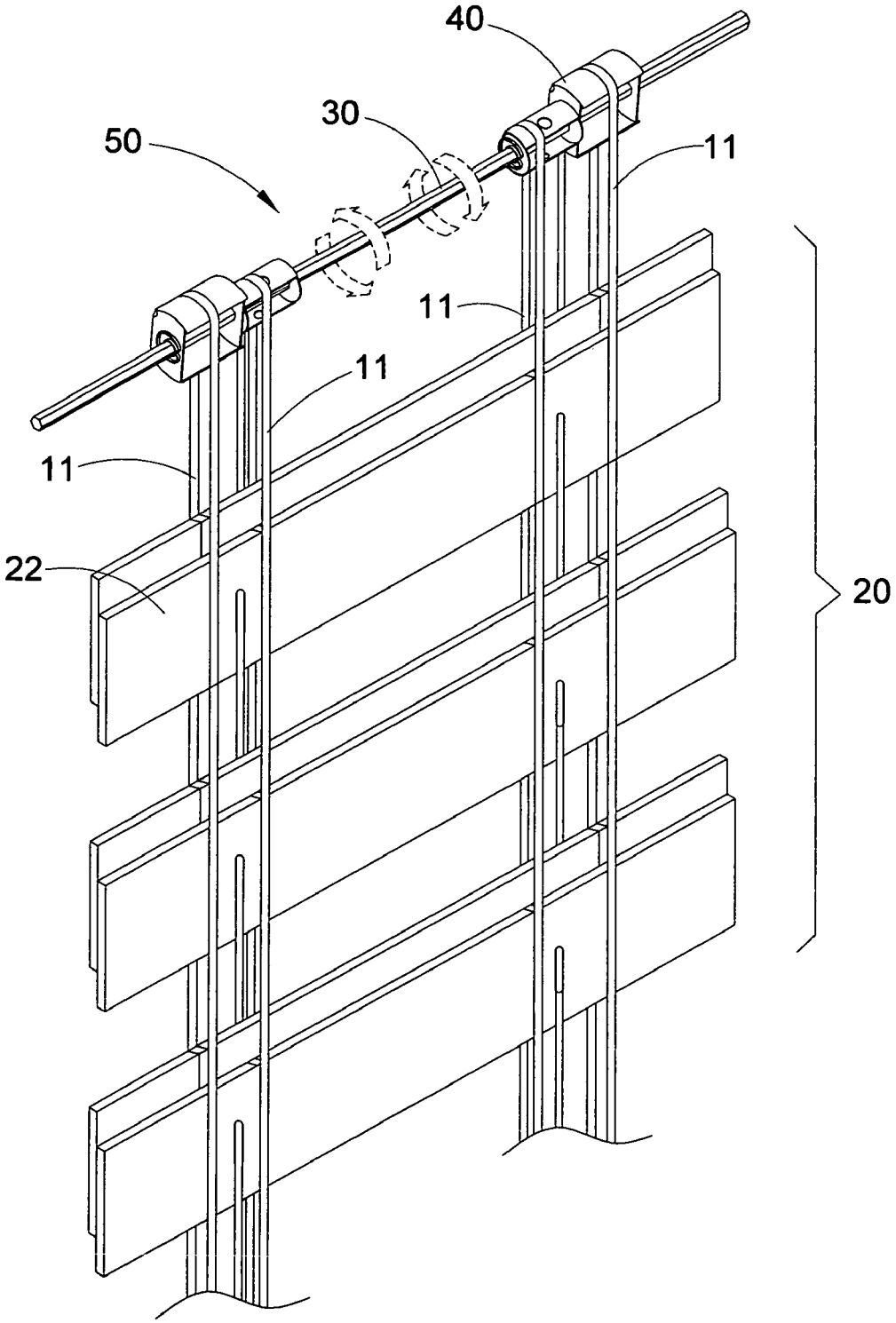
FIG. 6 is a perspective view of the blind according to the above preferred embodiment of the present invention, illustrating the operation of the blind.
Figure 6B:
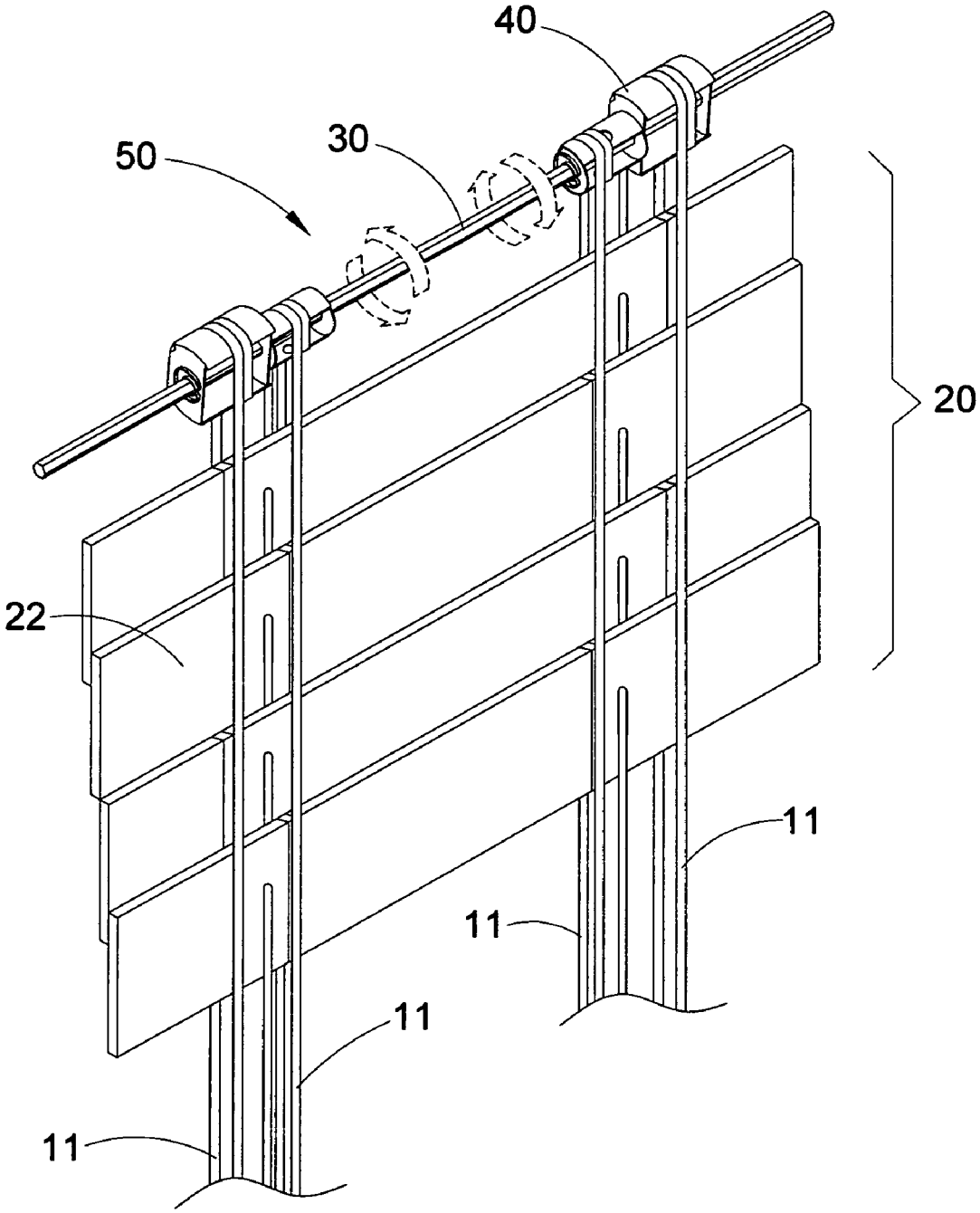
Figure 7:
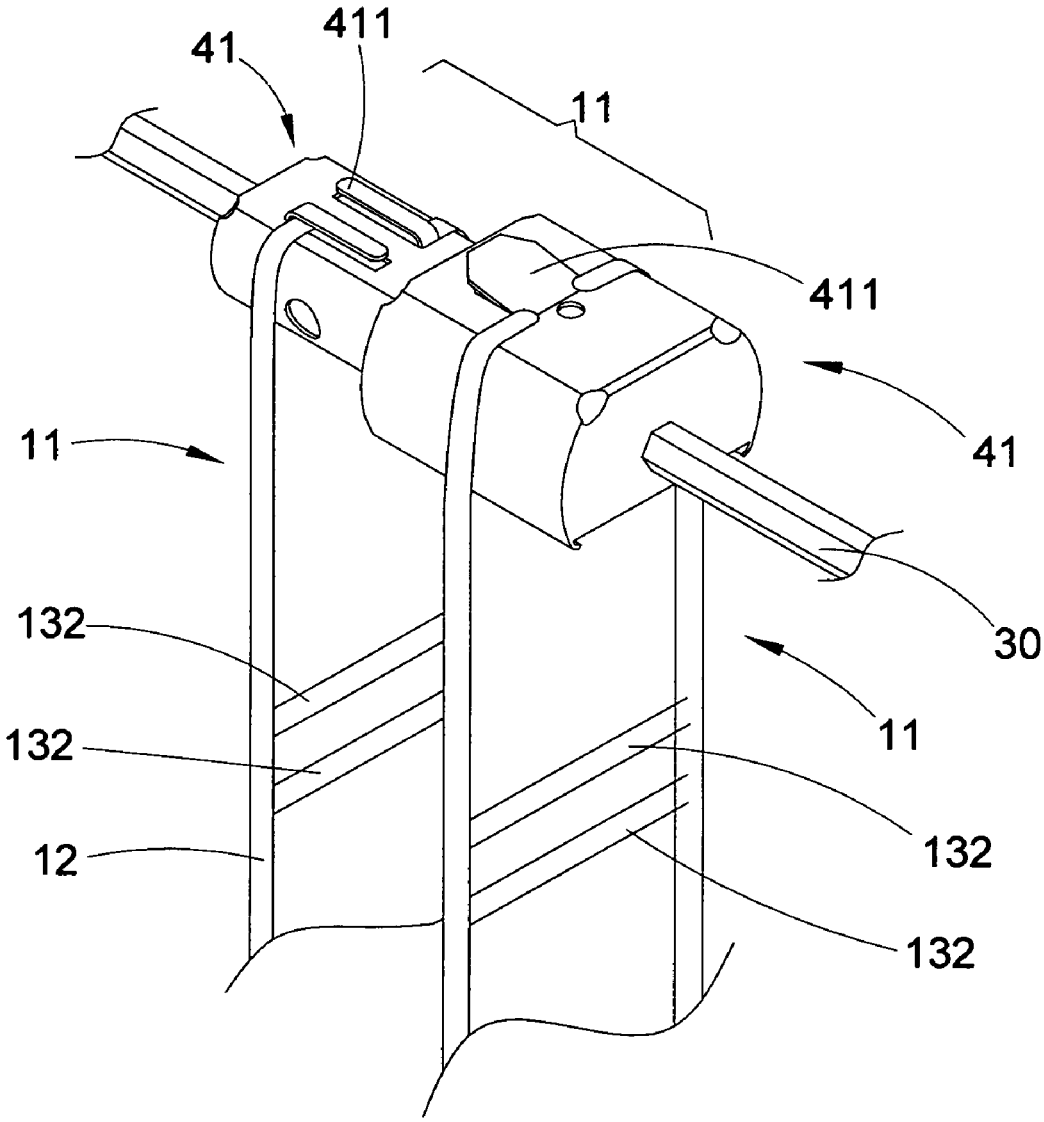
FIG. 7 is a perspective view of a controlling shaft unit according to the above preferred embodiment of the present invention.

Referring to FIG. 1 through FIG. 7 of the drawings, a controlling shaft 50 is used for controlling a blind according to a preferred embodiment of the present invention is illustrated, in which the blind comprises a cord lifting unit 10, a slat unit 20 and a beam 70.

The cord lifting unit 10 comprises a plurality of lift cords 11, each of the lift cords has two controlling cords 12 and a plurality of fixing cords 13, wherein two controlling cords 12 are corresponding to each other, and a distance 121 is between the two controlling cords 12, and a distance 131 is between two neighbor fixing cords 13.

Furthermore, each fixing cord 13 comprises two or more transverse cords 132, and two neighbor transverse cords 132 defines a fixing cavity 133, wherein the space between two neighbor fixing cavities is larger than two neighbor controlling cords 12.

The slat unit 20 is provided on the cord lifting unit 10, comprising a plurality of slat systems 21, wherein each slat system 21 is corresponding to a lift cord 11 of the cord lifting unit, and each slat system 21 comprises a plurality of slats 22.

The plurality of slats 22 of a slat system 21 are connected with the lift cord 11 of the cord lifting unit 10 from top to bottom.

The controlling shaft 50 for controlling blind is provided on the beam 70 of the blind, comprising a transverse shaft 30 and a plurality of shaft controlling units 40, wherein the plurality of shaft controlling units 40 is provided on the transverse shaft 30 in turn.

Due to the connecting relationship between the plurality of shaft controlling units 40 and the transverse shaft 30, when the transverse shaft 30 rotates, the plurality of shaft controlling units 40 can synchronously rotate with the transverse shaft 30.

Each shaft controlling unit 40 of the plurality of shaft controlling units 40 comprises a plurality of rotating members 41. When the shaft controlling unit 40 rotates with the transverse shaft 30, the rotating members 41 of each shaft controlling unit 40 move in different pace. With the synchronous movement of the shaft controlling units 40 with the transverse shaft 30, the particular points on the outer side of respective plurality of rotating members 41 of any shaft controlling unit 40 at the same level move to different extents.

In addition, the outer shape of the plurality of rotating members 41 approximates to a column. The longitudinal axis of the plurality of rotating members 41 that approximates to column is coincidence with the longitudinal axis of the transverse shaft 30, so that the rotating members 41 rotate stably when rotating with the transverse shaft 30.

The circumstances of the outer surface of each two rotating member 41 of the plurality of rotating members 41 are different with each other, so that when the plurality of shaft controlling units 40 rotate synchronously with the transverse shaft 30 to drive the plurality of rotating members 41 to rotate, that is to say when the transverse shaft 30 turns an angle, the plurality of rotating members 41 turn the same angle, the particular points on the outer side of respective plurality of rotating members 41 of any shaft controlling unit 40 at the same level move to different extents.

The plurality of rotating members comprise a plurality of large wheels and a plurality of small wheels, wherein the circumstance proportion of the large wheel and small wheel is determined by the switching speed of the blind.

Each rotating member 41 has a cord retaining hole 411 provided thereon.

The plurality of shaft controlling units 40 are connected with the cord lifting unit 10 of the blind, and furthermore, each rotating member 41 of the plurality of shaft controlling units 40 is connected with a lift cord 11 of the cord lifting unit 10 respectively.

The slat unit 20 is provided on the cord lifting unit 10, and each slat system 21 of the slat unit 20 is corresponding to a lift cord 11 of the cord lifting unit 10. Each slat system 21 comprises a plurality of slats 22, and the plurality of slats 22 of the slat system 21 are connected with a lift cord 11 of the cord lifting unit 10 from top to bottom.

Due to the relationship between the rotating members 41, lift cords 11 and the slats 22, the operation status of the slats 22 can be controlled via the rotating members 41.

The upper end of any group of lift cords 11 of the cord lifting unit 10 is fixed in the cord clap 411 of the rotating member 41 of the shaft controlling unit 40.

Figure 8:
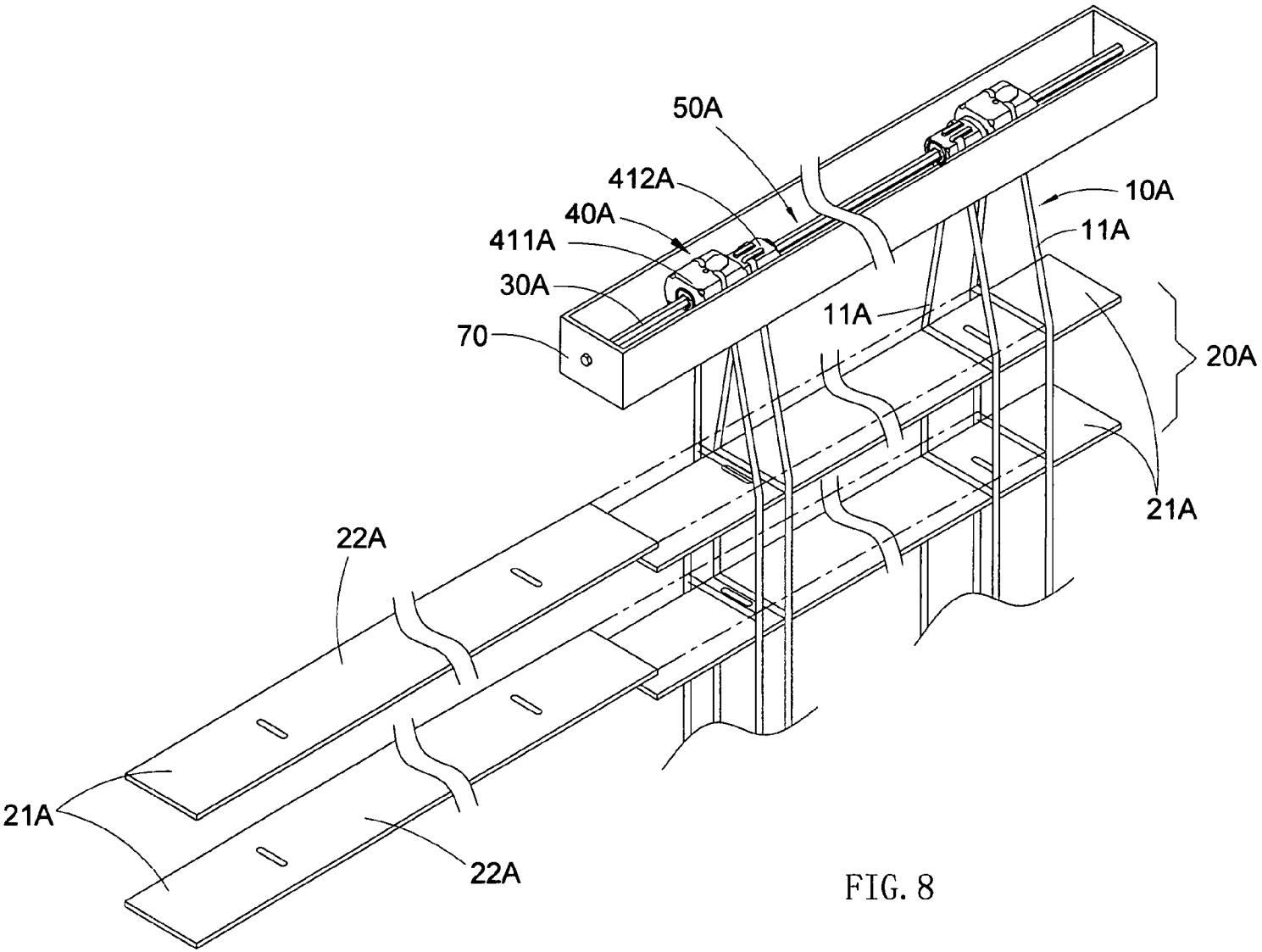
FIG. 8 is a partial exploded view of the blind of an alternative mode according to the above preferred embodiment of the present invention.

As shown in FIG. 8, a preferred embodiment of the present invention is illustrated. A controlling shaft 50A for controlling blind is provided on a beam of the blind, comprising a transverse shaft 30A and a plurality of shaft controlling units 40A, wherein the plurality of shaft controlling units 40A are provided on the transverse shaft 30A in turn.

Each shaft controlling units 40A comprise a large wheel 411A and a small wheel 412A, wherein the diameter of the large wheel is larger than the diameter of the small wheel.

The blind comprises a cord lifting unit 10A and a slat unit 20A.

The cord lifting unit 10A comprises a plurality of lift cords 11A, each of the lift cords has two controlling cords 12A and a plurality of fixing cords 13A, wherein two controlling cords 12A are corresponding to each other, and a distance 121A is between the two controlling cords 12A, and a distance 13A1 is between two neighbor fixing cords 13A.

The slat unit 20A is provided on the cord lifting unit 10A, comprising a plurality of slat systems 21. Each slat system 21A is corresponding to a lift cord 11A of the cord lifting unit 10A, and each slat system 21A comprises a plurality of slats 22A.

The slats 22A of the slat system 21A are connected with a lift cord 11A of the cord lifting unit 10A from top to bottom.

The upper end of the plurality of lift cords 11A of the cord lifting unit 10A are fixedly connected to the plurality of shaft controlling units 40A of the controlling shaft 50A respectively.

Two of the lift cords of the cord lifting unit 10A become one group, and fixedly connected the large wheel 411A and small wheel 412A of the shaft controlling units 40A respectively.

When the transverse shaft 30A of the controlling shaft 50A rotates, the plurality of controlling shafts 40A are driven to rotate together. Because the diameter of the larger wheel 411A is larger than the diameter of the small wheel 412A, the lifting speed of the lift cord 11A connected with the large wheel 411A is faster than the lifting speed of the lift cord 11A connected with the small wheel 412A.

At the same time, the lifting speed of the plurality of slats 22A of the slat system 21A on the lift cord 11A connected with the larger wheel 411A is larger than the lifting speed of the plurality of slats 22A of the slat system 21A on the lift cord 11A connected with the small wheel 412A.

Thus, a displacement difference is produced between the slats 22A of the slat system 21A on the lift cord 11A connected with the larger wheel 411A and the slats 22A of the slat system 21A on the lift cord 11A connected with the small wheel 412A.

Figure 9:
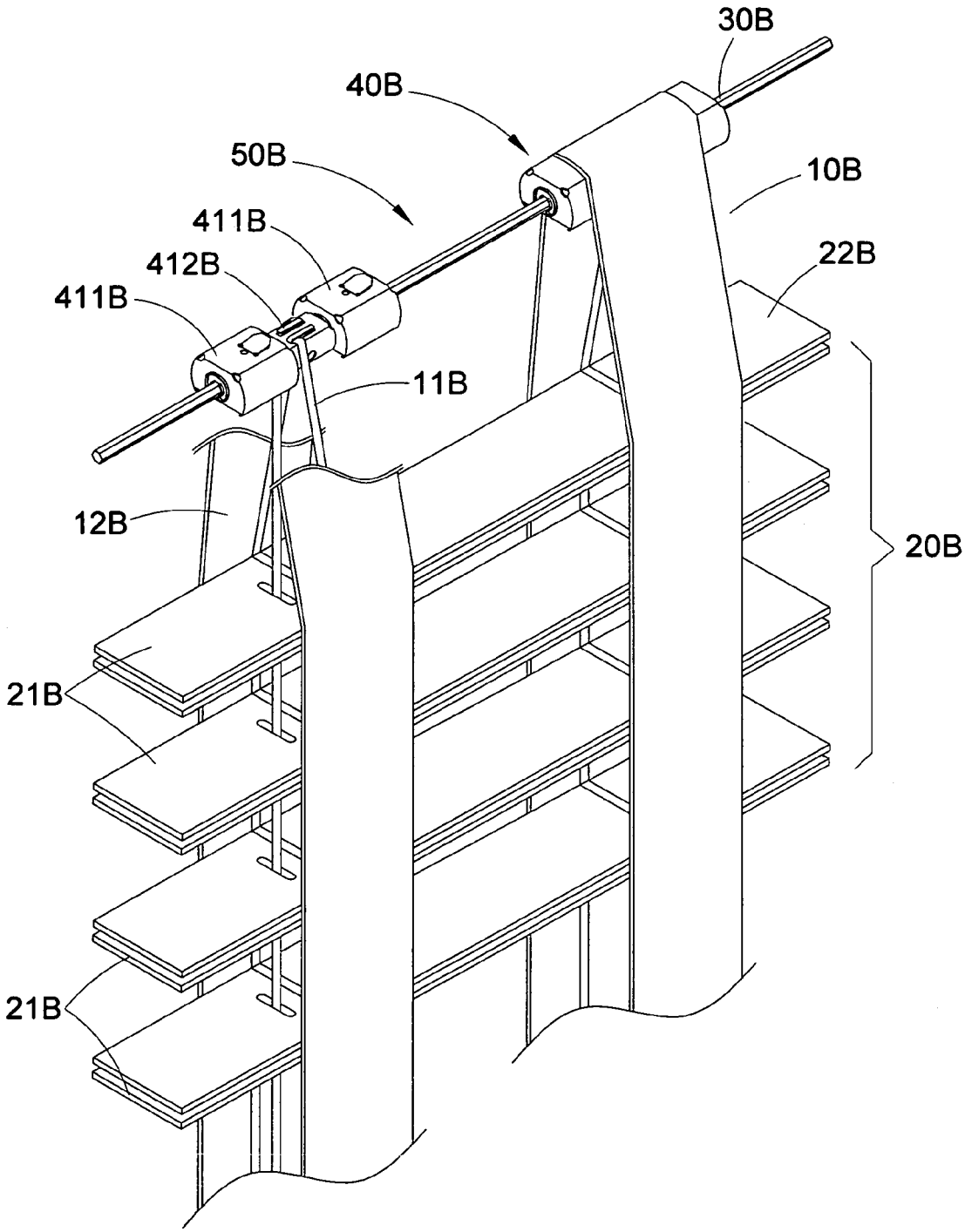
FIG. 9 is a perspective view of the blind of another alternative mode according to the above preferred embodiment of the present invention.
Figure 10:
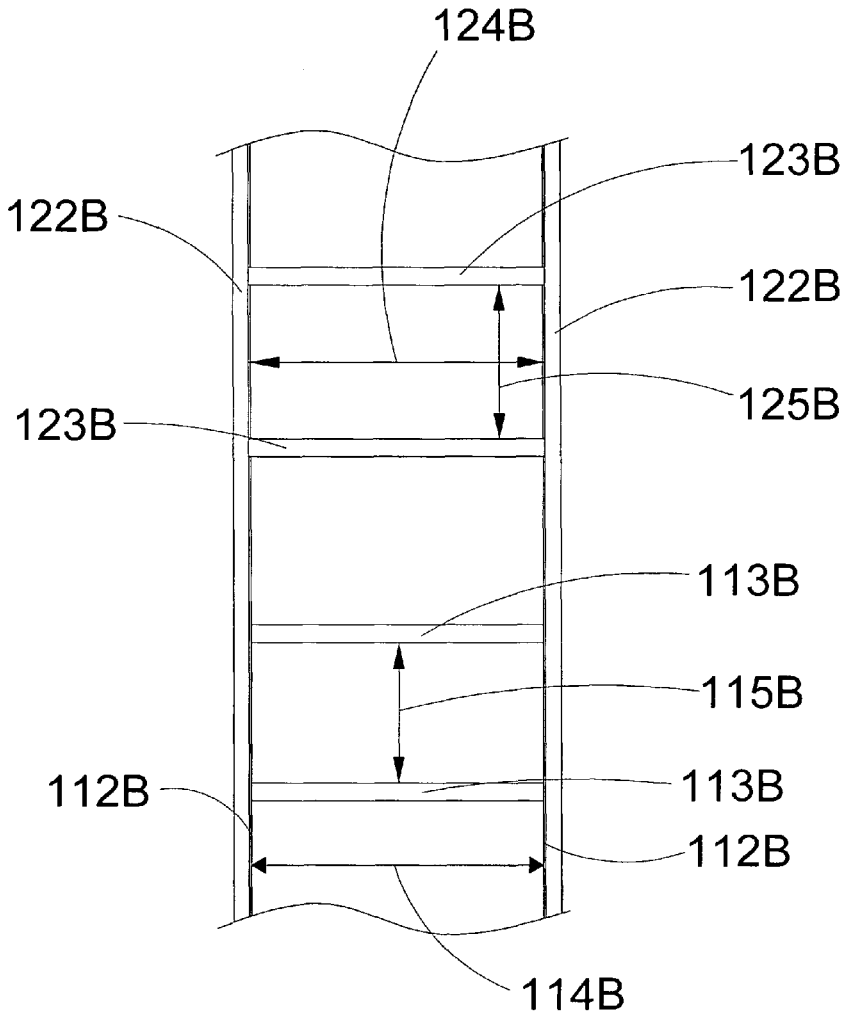
FIG. 10 is an illustrative view of the a cord lifting unit of the above alternative mode according to the above preferred embodiment of the present invention.

As shown in FIG. 9 and FIG. 10, another preferred embodiment of the present invention is illustrated. A controlling shaft 50B for controlling blind is provided on a beam of the blind, comprising a transverse shaft 30B and a plurality of shaft controlling units 40B, wherein the plurality of shaft controlling units 40B are provided on the transverse shaft 30A in turn.

Each shaft controlling units 40B comprise a large wheel 411B and a small wheel 412B, wherein the diameter of the large wheel is larger than the diameter of the small wheel.

Furthermore, the small wheel 412B is placed between the larger wheel groups 411A.

The blind comprises a cord lifting unit 10B and a slat unit 20B.

The cord lifting unit 10B comprises a plurality of lift cord groups 11B and a plurality of lift belt groups 12B. The number of the lift cord groups 11B and the lift belt groups 12B are same.

Each of the lift cord group 11B comprises two controlling cords 112B and a plurality of fixing cords 113B. The two controlling cords 112B are corresponding to each other. A space 114B is provided between the two controlling cords 112B. The fixing cords 113B are provided between two controlling cords 112B from top to bottom. A space 115B is provided between two neighboring fixing cords 113B.

Each lift belt group 12B comprises two controlling belts 122B and a plurality of fixing belts 123B. The two controlling belts 122B are corresponding to each other. A space 124B is provided between the two controlling belts 122B. The fixing belts 123B are provided between two controlling belts 122B from top to bottom. A space 125B is provided between two neighboring fixing belts 123B.

The slat unit 20B is provided on the cord lifting unit 10B, comprising a plurality of slat systems 21B, wherein each slat system 21B is corresponding to a lift cord group 11B or a lift belt group 12B of the cord lifting unit, and each slat system 21B comprises a plurality of slats 22B.

The plurality of slats 22B of a slat system 21B are connected with the lift cord group 11B or a lift belt group 12B of the cord lifting unit 10 from top to bottom.

The upper end of the lift cord groups 11B and the lift belt group 12B of the cord lifting unit 10B are fixedly connected to the plurality of shaft controlling units 40B of the controlling shaft 50B respectively.

A lift cord group 11B and a lift belt group 12B of the cord lifting unit 10A become one group, and fixedly connected the small wheel 412B and large wheel 411B of the shaft controlling units 40B respectively.

When the transverse shaft 30B of the controlling shaft 50B rotates, the plurality of controlling shafts 40B are driven to rotate together. Because the diameter of the larger wheel 411B is larger than the diameter of the small wheel 412B, the lifting speed of the lift belt group 12B connected with the large wheel 411B is faster than the lifting speed of the lift cord group 11B connected with the small wheel 412B.

At the same time, the lifting speed of the plurality of slats 22B of the slat system 21B on the lift belt 12B connected with the larger wheel 411B is faster than the lifting speed of the plurality of slats 22A of the slat system 21A on the lift cord group 11B connected with the small wheel 412B.

Thus, a displacement difference is produced between the slats 22B of the slat system 21B on the lift belt group 12B connected with the larger wheel 411B and the slats 22A of the slat system 21A on the lift cord group 11B connected with the small wheel 412B.

In the embodiments described above, the transverse shaft 30 (30A, 30B) is driven to rotate via electrical power or mechanical transmission automatically or manually, so as to drive the shaft controlling unit 40 (40A, 40B) to rotate, so that the particular points on respective plurality of rotating members of any shaft controlling unit 40 (40A, 40B) at the same level move to different extents.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A controlling shaft for controlling a blind provided on a beam of the blind, comprising:

a blind; and a transverse shaft; and a plurality of shaft controlling units provided on said transverse shaft, in such a manner that when said transverse shaft rotates, said plurality of shaft controlling units can synchronously rotate with said transverse shaft, wherein each of said shaft controlling units comprises a plurality of rotating members, wherein when said shaft controlling unit rotates with said transverse shaft, said rotating members of each of said shaft controlling units move in different pace, and with a synchronous movement of said shaft controlling units with said transverse shaft, wherein particular points on an outer side of respective plurality of rotating members of said shaft controlling unit at same level move to different extents, wherein an outer shape of said plurality of rotating members approximates to a column, and a longitudinal axis of said plurality of rotating members that approximates to column is coincident with a longitudinal axis of said transverse shaft, so that said rotating members rotate stably when rotating with said transverse shaft, wherein a circumference of an outer surface of each two rotating member are different from each other, so that when said plurality of shaft controlling units rotate synchronously with said transverse shaft to drive said plurality of rotating members to rotate, said plurality of rotating members turn the same angle, wherein particular points on an outer side of respective plurality of rotating members of any shaft controlling unit at same level move to different extents, wherein each of said rotating members has a cord retaining hole provided thereon wherein said blind comprises a cord lifting unit, wherein said cord lifting unit comprises a plurality of lift cords, each of said lift cords has two controlling cords and a plurality of fixing cords, wherein two controlling cords are corresponding to each other and are fixed to a respective rotating member, and a distance is between said two controlling cords, wherein said fixing cords are provided between said two controlling cords from top to bottom, and a distance is between two neighbor fixing cords, wherein each said fixing cord comprises two or more transverse cords, and two neighbor transverse cords defines a fixing cavity, wherein a space between two neighbor fixing cavities is larger than two neighbor controlling cords.

2. The controlling shaft for controlling a blind, as recited in claim 1, wherein said plurality of rotating members comprise a plurality of large wheels and a plurality of small wheels, wherein a circumstance proportion of said large wheel and small wheel is determined by a switching speed of said blind.

3. The controlling shaft for controlling a blind, as recited in claim 1, wherein said blind comprises a slat unit, wherein said slat unit is provided on said cord lifting unit, comprising a plurality of slat systems, wherein each slat system is corresponding to a lift cord of said cord lifting unit, and each slat system comprises a plurality of slats, wherein said plurality of slats of a slat system are connected with said lift cord of said cord lifting unit from top to bottom.

4. The controlling shaft for controlling a blind, as recited in claim 2, wherein said blind comprises a slat unit, wherein said slat unit is provided on said cord lifting unit, comprising a plurality of slat systems, wherein each slat system is corresponding to a lift cord of said cord lifting unit, and each slat system comprises a plurality of slats, wherein said plurality of slats of a slat system are connected with said lift cord of said cord lifting unit from top to bottom.

5. The controlling shaft for controlling a blind, as recited in claim 4, wherein said plurality of shaft controlling units are connected with said cord lifting unit of said blind, and furthermore, each rotating member of said plurality of shaft controlling units is connected with a lift cord of said cord lifting unit respectively, wherein said slat unit is provided on said cord lifting unit, and each slat system of said slat unit is corresponding to a lift cord of said cord lifting unit, wherein each slat system comprises a plurality of slats, and said plurality of slats of said slat system are connected with a lift cord of said cord lifting unit from top to bottom, wherein due to a relationship between said rotating members, said lift cords and said slats, operation status of said slats can be controlled via said rotating members.

6. The controlling shaft for controlling a blind, as recited in claim 1, wherein a controlling shaft for controlling blind is provided on a beam of said blind, comprising a transverse shaft and a plurality of shaft controlling units, wherein said plurality of shaft controlling units are provided on said transverse shaft in turn, wherein each shaft controlling units comprise a large wheel and a small wheel, wherein a diameter of said large wheel is larger than a diameter of said small wheel, wherein said blind comprises a slat unit, wherein said slat unit is provided on said cord lifting unit, comprising a plurality of slat systems, wherein each slat system is corresponding to a lift cord of said cord lifting unit, and each slat system comprises a plurality of slats, wherein said slats of said slat system are connected with a lift cord of said cord lifting unit from top to bottom, wherein an upper end of said plurality of lift cords of said cord lifting unit are fixedly connected to said plurality of shaft controlling units of said controlling shaft respectively, wherein two of said lift cords of said cord lifting unit become one group, and fixedly connected said large wheel and small wheel of said shaft controlling units respectively, wherein when said transverse shaft of said controlling shaft rotates, said plurality of controlling shafts are driven to rotate together, wherein because a diameter of said larger wheel is larger than a diameter of said small wheel, a lifting speed of said lift cord connected with said large wheel is faster than a lifting speed of said lift cord connected with said small wheel, wherein a lifting speed of said plurality of slats of said slat system on said lift cord connected with said larger wheel is larger than a lifting speed of said plurality of slats of said slat system on said lift cord connected with said small wheel.

7. The controlling shaft for controlling a blind, as recited in claim 5, wherein a controlling shaft for controlling blind is provided on a beam of said blind, comprising a transverse shaft and a plurality of shaft controlling units, wherein said plurality of shaft controlling units are provided on said transverse shaft in turn, wherein each shaft controlling units comprise a large wheel and a small wheel, wherein a diameter of said large wheel is larger than a diameter of said small wheel, wherein said small wheel is placed between said larger wheel groups, wherein said blind further comprises a slat unit, wherein said cord lifting unit further comprises a plurality of lift cord groups and a plurality of lift belt groups, a number of said lift cord groups and said lift belt groups are the same, wherein each of said lift cord group comprises two of said controlling cords and a said plurality of fixing cords, wherein said two controlling cords are corresponding to each other, wherein a space is provided between said two controlling cords, wherein said fixing cords are provided between two controlling cords from top to bottom, wherein a space is provided between two neighboring fixing cords, wherein each lift belt group comprises two controlling belts and a plurality of fixing belts, wherein said two controlling belts are corresponding to each other, wherein a space is provided between said two controlling belts, wherein fixing belts are provided between two controlling belts from top to bottom, wherein a space is provided between two neighboring fixing belts, wherein said slat unit is provided on said cord lifting unit, comprising a plurality of slat systems, wherein each slat system is corresponding to a lift cord group or a lift belt group of said cord lifting unit, and each slat system comprises a plurality of slats, wherein an upper end of said lift cord groups and said lift belt group of said cord lifting unit are fixedly connected to said plurality of shaft controlling units of said controlling shaft respectively, wherein a lift cord group and a lift belt group of said cord lifting unit become one group, and fixedly connected said small wheel and large wheel of said shaft controlling units respectively, wherein when said transverse shaft of said controlling shaft rotates, said plurality of controlling shafts are driven to rotate together, wherein because a diameter of said larger wheel is larger than a diameter of said small wheel, said lifting speed of said lift belt group connected with said large wheel is faster than said lifting speed of said lift cord group connected with said small wheel, wherein said lifting speed of said plurality of slats of said slat system on said lift belt connected with said larger wheel is faster than a lifting speed of the plurality of slats of said slat system on said lift cord group connected with said small wheel.

8. The controlling shaft for controlling a blind, as recited in claim 6, wherein said transverse shaft is driven to rotate via electrical power or mechanical transmission automatically or manually, so as to drive said shaft controlling unit to rotate.

9. The controlling shaft for controlling a blind, as recited in claim 7, wherein said transverse shaft is driven to rotate via electrical power or mechanical transmission automatically or manually, so as to drive said shaft controlling unit to rotate.

* * * * *